US008556781B1

(12) United States Patent
Fitzpatrick

(10) Patent No.: US 8,556,781 B1
(45) Date of Patent: Oct. 15, 2013

(54) BAR FOR EXERCISE

(75) Inventor: Timothy Fitzpatrick, Islip Terrace, NY (US)

(73) Assignee: BTF Global Corp., Deer Park, NY (US)

( * ) Notice: Subject to any disclaimer, the term of this patent is extended or adjusted under 35 U.S.C. 154(b) by 104 days.

(21) Appl. No.: 12/931,009

(22) Filed: Jan. 21, 2011

Related U.S. Application Data

(63) Continuation-in-part of application No. 12/459,820, filed on Jul. 8, 2009, now abandoned.

(60) Provisional application No. 61/198,727, filed on Nov. 7, 2008.

(51) Int. Cl.
*A63B 21/00* (2006.01)

(52) U.S. Cl.
USPC ..... 482/106; 482/51; 482/71

(58) Field of Classification Search
USPC ..... 482/104–108
See application file for complete search history.

(56) References Cited

U.S. PATENT DOCUMENTS

| | | | | |
|---|---|---|---|---|
| 2,722,419 | A | 11/1955 | Tarapczynski | |
| D261,788 | S | 11/1981 | Burns | |
| 4,585,229 | A | 4/1986 | Brasher | |
| 4,618,143 | A | 10/1986 | Twardosz | |
| 4,822,035 | A | 4/1989 | Jennings et al. | |
| RE33,218 | E | 5/1990 | Twardosz | |
| D317,641 | S | 6/1991 | Gerard | |
| 5,024,434 | A | 6/1991 | Smith | |
| D320,636 | S | 10/1991 | Eckler | |
| 5,080,349 | A | 1/1992 | Vittone | |
| 5,211,616 | A | 5/1993 | Riley, Jr. | |
| 5,725,461 | A * | 3/1998 | Bogard, II | 482/106 |
| 6,022,300 | A | 2/2000 | Hightower | |
| D425,151 | S | 5/2000 | Landfair | |
| 6,572,515 | B2 * | 6/2003 | De La Garza | 482/106 |
| 7,056,268 | B2 | 6/2006 | Emick | |
| 7,094,186 | B2 | 8/2006 | Diakonov et al. | |
| 7,244,220 | B2 | 7/2007 | Carney | |
| 2003/0130096 | A1 * | 7/2003 | LaCroce | 482/106 |
| 2005/0202942 | A1 | 9/2005 | De Lana | |
| 2008/0176723 | A1 * | 7/2008 | Johnson | 482/106 |
| 2010/0069206 | A1 * | 3/2010 | Viselman | 482/106 |
| 2010/0323854 | A1 * | 12/2010 | Brandenburg | 482/106 |

OTHER PUBLICATIONS

Joe Langevin, The Football Bar, www.repsdirect.net (web pages).
Troy Barbell & Fitness, www.troybarbell.com (web pages).

* cited by examiner

*Primary Examiner* — Jerome W Donnelly
(74) *Attorney, Agent, or Firm* — Greensfelder, Hemker & Gale, P.C.; Donald J. Fitzpatrick

(57) ABSTRACT

A barbell characterized by a longitudinal bar with two hand gripping portions, with sufficient spacing between gripping portions to provide clearance for the torso, head or neck, where the gripping portions are characterized by first and second diamond-like shaped exterior portions enclosing gripping windows, where the windows each contain at least one gripping bar, non-parallel to the longitudinal bar, where the first and second diamond-like portions have a first and second interior end portions which, with the intermediate region, define a cambered gripping portion wherein the gripping bars and the exterior portion of the gripping windows are designed to provide a plurality of gripping positions and angles for the user.

20 Claims, 14 Drawing Sheets

BAR FOR EXERCISE

CROSS-REFERENCE TO RELATED APPLICATION

This application claims the benefit of provisional application No. 61/198,727, filed Nov. 7, 2008, and utility patent application Ser. No. 12/459,820, filed Jul. 8, 2009, which is hereby incorporated by reference.

FIELD OF THE INVENTION

The present invention relates to devices in the field of physical fitness. This invention specifically relates to a barbell suitable for use in exercise. The barbell has gripping portions that are diamond-like shaped to provide gripping windows with multiple gripping surfaces and angles that allow the user to use the barbell in a variety of exercises.

BACKGROUND OF THE INVENTION

Barbells have been used for many years for exercise and physical fitness. A barbell typically consists of a straight longitudinal bar which forms a longitudinal axis with a pair of grip portions at the sides of the middle portion for grasping with the weightlifter's two hands, and a weight receiver on each end of the bar. By placing weights of different sizes on the weight receivers, a barbell of different weights can be constructed.

In use, a weightlifter grasps the barbell at the grip portions, and lifts the barbell to exercise. When a weight lifter does a bench press or a shoulder press, he uses a pronated or palms-down grip. This grip stresses the shoulders, wrists, and other joints, because the palms are not in their natural relaxed position.

Some exercises are difficult using barbells. Exercises such as the bench press, shoulder press, behind the neck press shoulder press, curls and shrugs are difficult, because some barbells do not provide clearance for movement around the user's body, specifically the head, neck or torso. This limits the range of motion. The present invention provides clearance for these exercises, because the diamond-like shape of the grip portion of the bar allows repositioning of the user's hands to provide the needed clearance. The present invention has multiple gripping surfaces, providing numerous positions for a variety of exercises.

The present invention provides gripping surfaces on crossbars that are either palm-facing-palm or approximately palm-facing-palm. This is a neutral grip, because it is the natural, relaxed position of palms, and it does not stress the shoulders, wrists, and other joints. Additionally, the interior end portion of the diamond-like shape acts as a cambered (or bowed) barbell shape that is used for upward grip curls and other exercises. None of the cited references below provide a barbell with diamond-like openings that can provide both a neutral grip on its crossbars and a cambered portion for upward grips that allows a full range of motion.

A barbell with rotating grips enclosed in a circle is disclosed in U.S. application 2008/0176723. Such a barbell is complicated in construction, and has limited positions for hand gripping, since the distance between the circles is fixed. U.S. patent application 2003/01300096 discloses a barbell with plural hand gripping positions, which hinders range of motion because the corners of the rectangular grip portion extend into areas that could impact the user's body. It also limits the variety of angles possible when gripping the barbell, because the grips are approximately orthogonal to the longitudinal bar, so that other grip angles are not possible. Design patent D317,641 discloses a dumbbell which is not a barbell and is not suitable for many of the exercises contemplated in the present invention. Design application D320,636 discloses a barbell which provides a variety of gripping positions, but appears unstable and unsuitable for heavy weight-lifting, because the barbell pivoting unexpectedly along its longitudinal axis may harmfully impact the user's body, particularly the head, neck, torso, waist and legs, and cause injury. U.S. Pat. No. 2,722,419 discloses a barbell that may provide clearance for some types of lifting, but loses clearance if the barbell pivots along its longitudinal axis, possibly harming the user.

SUMMARY OF THE INVENTION

The present invention is a barbell suitable for a variety of exercises, including shoulder press, behind the neck press, military press and the shrug, wherein the barbell is characterized by a longitudinal bar with two hand gripping portions, with sufficient spacing between gripping portions to provide clearance for the torso, head or neck, where the gripping portions are characterized by first and second diamond-like shaped exterior portions enclosing a gripping window, where the window contains at least one gripping bar, non-parallel to the longitudinal bar, wherein the first and second diamond-like portions have a first and second interior end portions which, with the intermediate region, define a cambered gripping portion; and wherein the gripping bar and the exterior portion of the gripping window are designed to provide a plurality of gripping positions for the user. The present invention provides clearance when used, and provides multiple grip positions for a variety of exercises.

BRIEF DESCRIPTION OF THE DRAWINGS

The preferred embodiment of the invention is disclosed, but not limited to, the following drawings.

FIG. 1 (*b*) is a fragmentary perspective view of an embodiment of the invention.

FIG. 1 (*c*) is a fragmentary perspective view of an embodiment of the invention.

FIG. 1 (*d*) is a perspective view of a longitudinal bar of the prior art.

FIG. 9(*b*) is a perspective view of the assembled portable barbell of the invention.

FIG. 10(*b*) is a perspective view of the barbell of the invention with an underhand grip.

FIG. 10(*c*) is a perspective view of the barbell of the invention with a palm inward grip.

DETAILED DESCRIPTION OF A PREFERRED EMBODIMENT

Figure 1A:
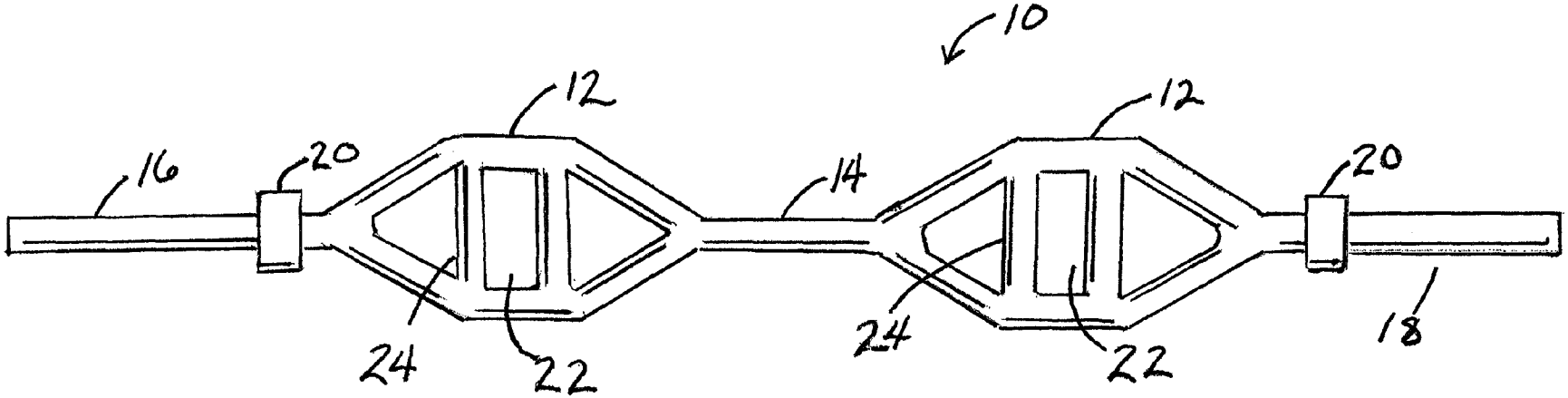
FIG. 1 (*a*) is a fragmentary perspective view of an embodiment of the invention.
Figure 1B:
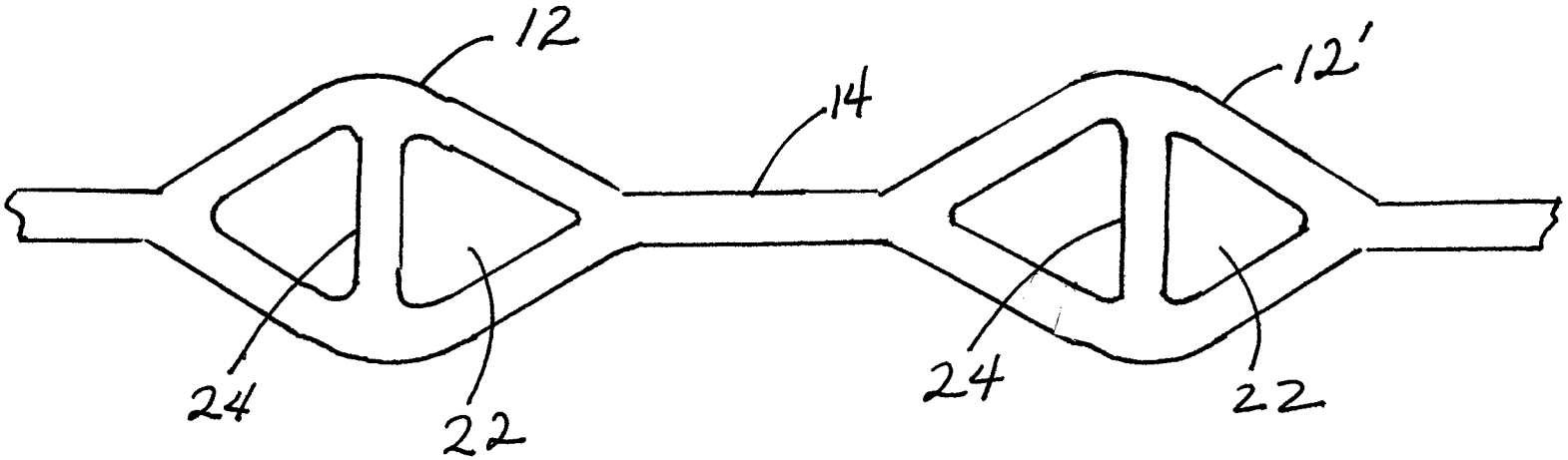
Figure 1C:
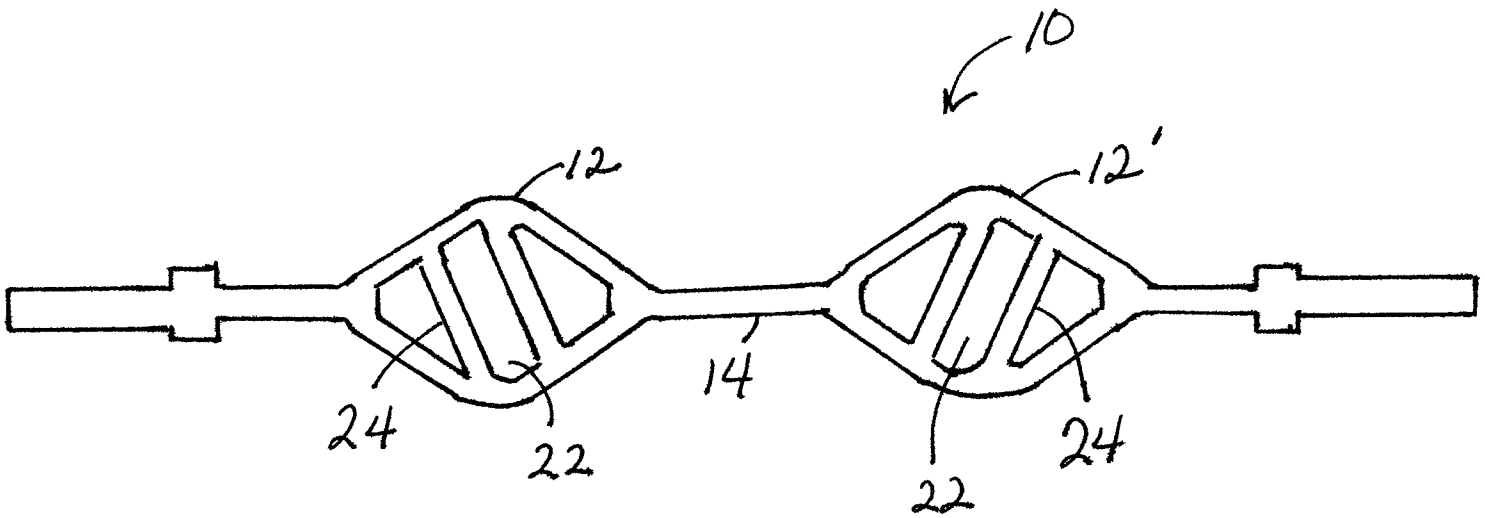
Figure 1D:
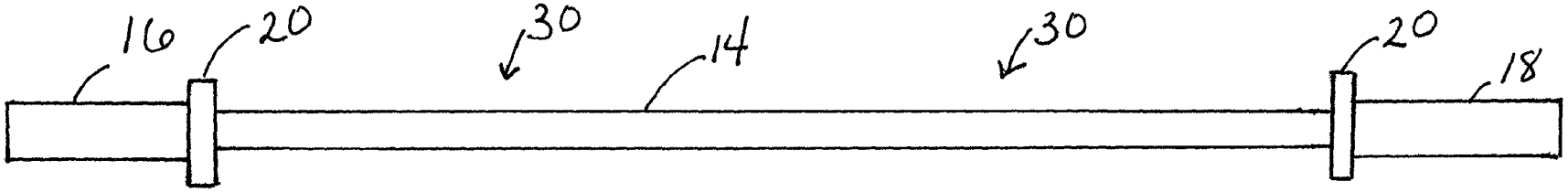

Referring to FIG. 1(*a*), the invention is represented generally as barbell 10. The parameters defining the barbell 10 are virtually identical to conventional competition or Olympic style barbells, that is, barbell 10 has the same overall length, mass/weight, and diameter as a competition or Olympic style barbell. The barbell 10 includes a longitudinal bar having a first end 16 and a second end 18, and an intermediate region 14 having a center point. The first end 16 has a weight supporting section including an inner collar 20 and an outer collar (not shown). Typically, the collars receive and secure weight plates, typically circular weight plates, so as to retain and hold the weights in place. The inner collar also provides a standard stop position preventing the weights from encroaching toward the intermediate region 14 of the bar. Likewise, the second end 18 has a weight supporting section including an inner collar and an outer collar. The weight supporting sections may have a diameter slightly larger than the diameter of the intermediate region of the bar. Typically, the conventional or Olympic style bar is 1.25 inches (approx. 42 mm) in diameter, while the weight supporting end sections are typically 1.87 inches (approx. 63 mm). The weight plates supported at each end of the bar are approximately equal in mass.

The intermediate region 14 of the bar includes a center point about which the barbell 10 is symmetrical and balanced. Approximately equidistant from the center point of the barbell 10 and on opposite sides thereof, is a first gripping portion 12 and a second gripping portion 12'. The first and second gripping portions 12 and 12' are used in the manipulation of the barbell 10 during an exercise regiment. The gripping portions 12 are characterized by a diamond-like exterior portion enclosing a gripping window 22. In the window 22 is at least one crossbar 24 non-parallel to the longitudinal bar. The gripping portions 12 and 12', and the at least one crossbar 24 provide multiple gripping surfaces and gripping angles. FIG. 1(*a*) shows two crossbars 24 in the window 22 of the barbell 10.

The multiple gripping surfaces and gripping angles provided by the barbell 10 allow the user to perform various free weight training exercises with less pain and discomfort in the shoulders, because the direction of the hands gripping the barbell can accommodate many angles and positions. The various angles and positions allow the user to achieve a complete range of motion with every exercise, and allow the user to exercise many different muscle groups safely and effectively. As a result, there is less likelihood of the user having an injury when exercising, and the exercises are more effective.

The distance between the gripping portions 12 and 12' is critical, in that there must be sufficient clearance for the head, neck, torso, or some other body part, to allow the full range of motion when the barbell 10 is used for exercising. A preferred range is from about eight to fifteen inches. A more preferred range is from about nine to twelve inches. The width of the diamond-like gripping portion exterior is from about six to twelve inches. A preferred width is from about seven to ten inches. Although the preferred embodiments of the diamond-like shape of the gripping portions shown in the figures are completely symmetrical, non-symmetrical shapes are also embodied within the present invention.

Referring to FIG. 1(*b*), the gripping portion 12 has one crossbar 24 which is essentially perpendicular to the longitudinal bar.

Referring to FIG. 1(*c*), the gripping portion 12 has two parallel crossbars 24 which are non-orthogonal to the longitudinal bar and provide a variety of gripping surfaces.

Referring to FIG. 1(*d*), a traditional barbell of the prior art with a straight gripping portion 30 is embodied.

Figure 6:
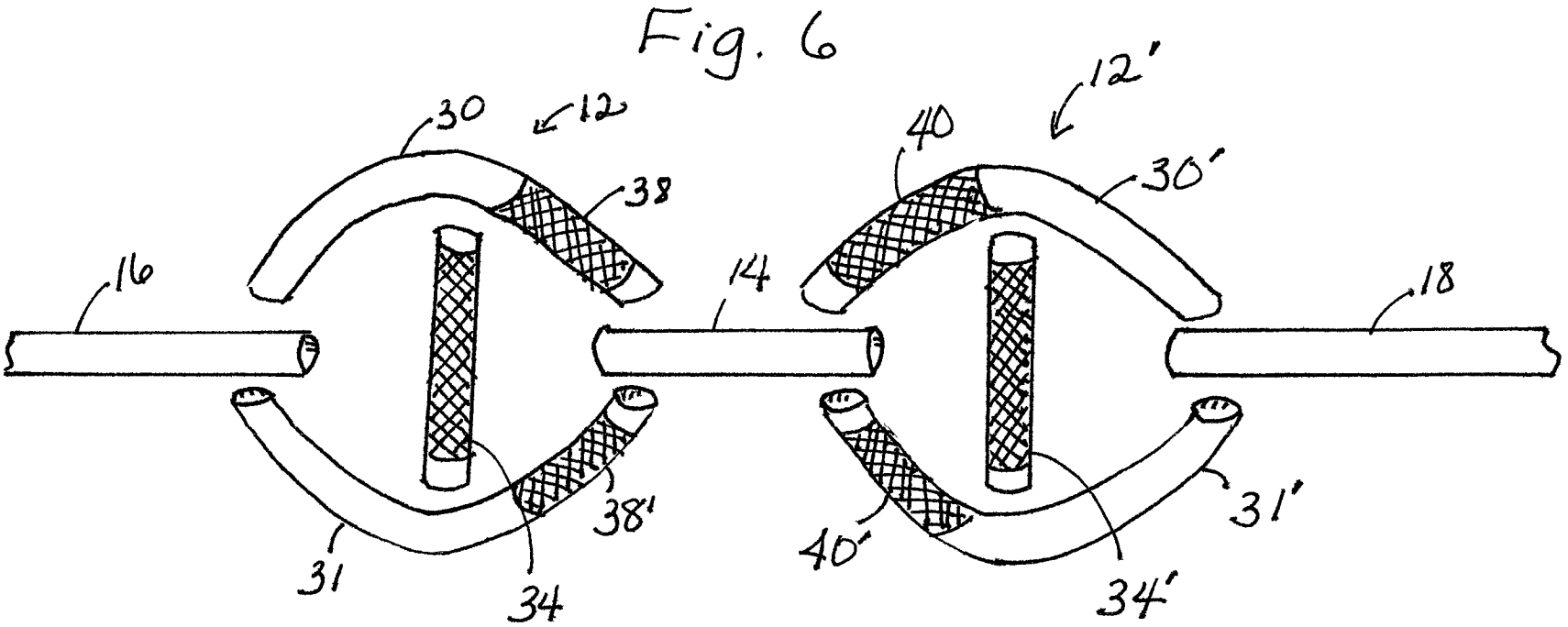
FIG. 6 is a perspective view of the unassembled parts of the barbell of the invention.

FIG. 6 illustrates an arrangement of the elements of barbell 10 prior to assembly into a finished product. These elements include first end 16, second end 18 and intermediate region 14. As shown in FIG. 1(*a*) gripping portions 12 and 12' are located equidistant from center of barbell 10. As shown in FIG. 6 gripping portions 12 and 12' each comprise a pair of arcuate segments and a crossbar. Thus gripping portion 12 consists of arcuate segments 30 and 31 and crossbar 34 whereas gripping portion 12' consists of arcuate segments 30' and 31' and crossbar 34'.

To further facilitate using the barbell of this invention the interior end portions 38 and 38' of arcuate segments 30 and 31 are knurled around their entire circumferences and vertical segments 34 and 34' are likewise knurled around its entire circumference. In a similar manner the interior portions 40 and 40' of arcuate segments 30' and 31' are knurled around their entire circumferences. The knurled surfaces described herein provide two very important features of this invention. First they guide the user to the barbell's proper lifting location. By locating the knurled surfaces on the inside of gripping portions 12 and 12' the user knows exactly where the barbell should be gripped for a proper exercise routine. It is well known that exercise can cause the hands to perspire which can result in the barbell slipping during usage resulting in a possible injury. A knurled surface enhances gripping and reduces accidental slipping of the barbell.

Figure 7:
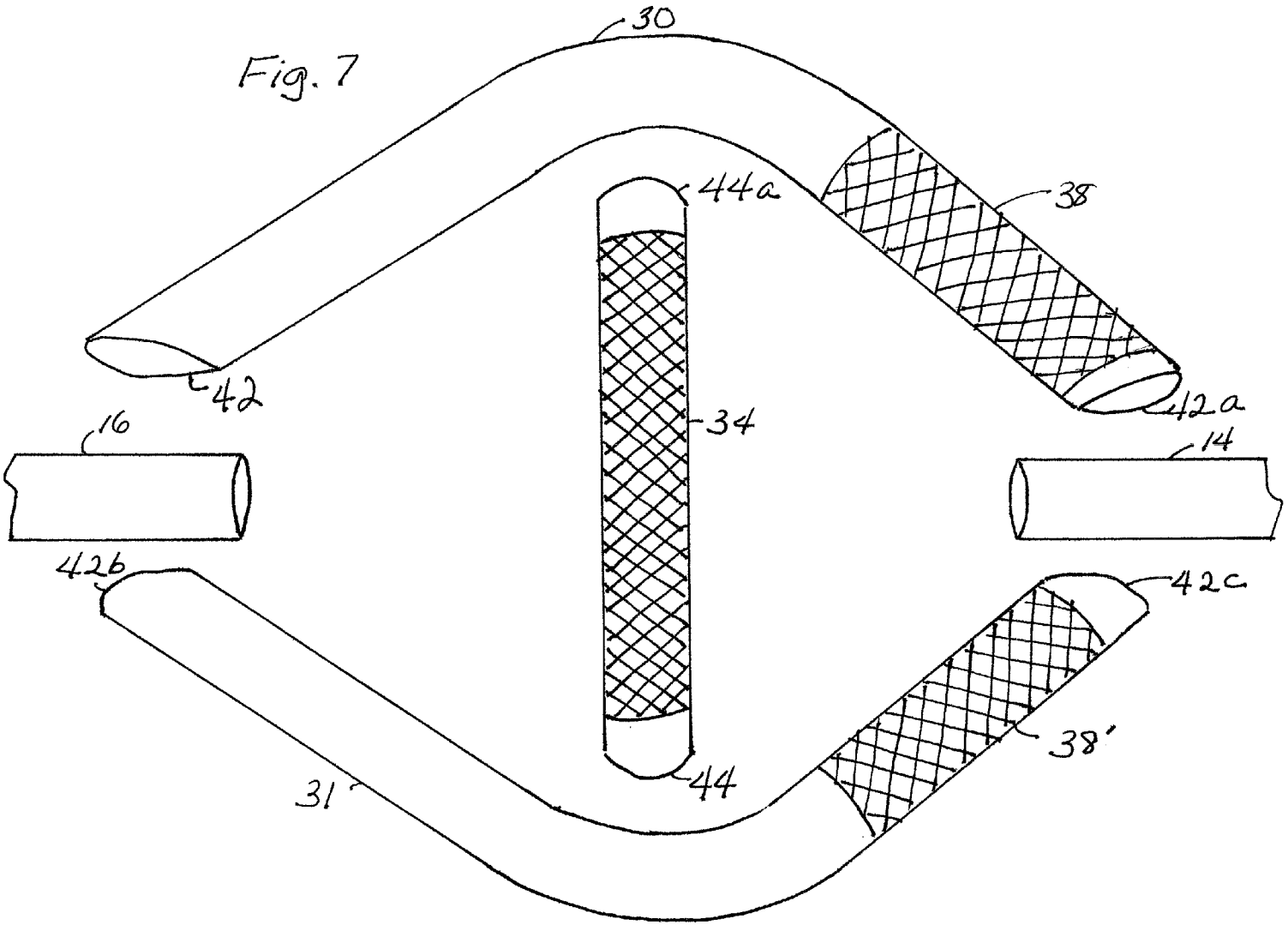
FIG. 7 is a perspective view of the unassembled parts of the gripping portion of the barbell of the invention.

A further design feature of the present invention is shown in FIG. 7. The ends 42, 42*a*, 42*b* and 42*c* of arcuate segments 30 and 31 are curved in a concave manner so that they can mate with end portions 16 and 18, and intermediate region 14. In a similar manner ends 44 and 44*a* of crossbar 34 are also curved in a concave manner so they can mate respectively with arcuate segments 30 and 31.

Thus when the individual elements of barbell 10 are assembled into a finished product capable of being used as for example by welding, the elements will all fit together in an attractive product without any misfitting elements.

Figure 8:
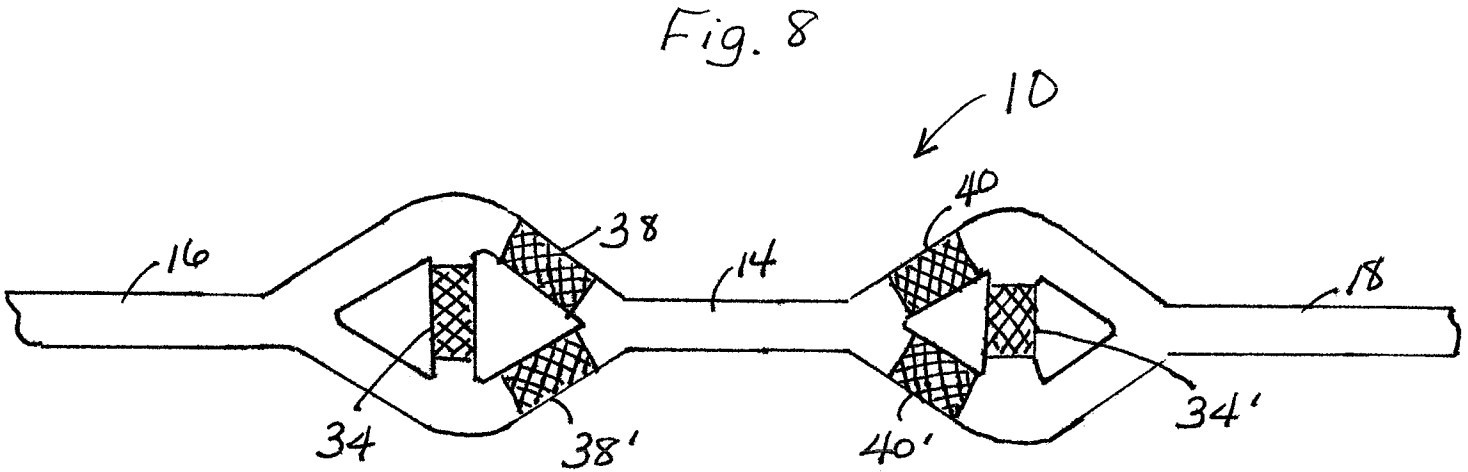
FIG. 8 is a perspective view of the assembled parts of the barbell.

FIG. 8 illustrates an assembled and completed barbell constructed in accordance with the description described therein.

Figure 9A:
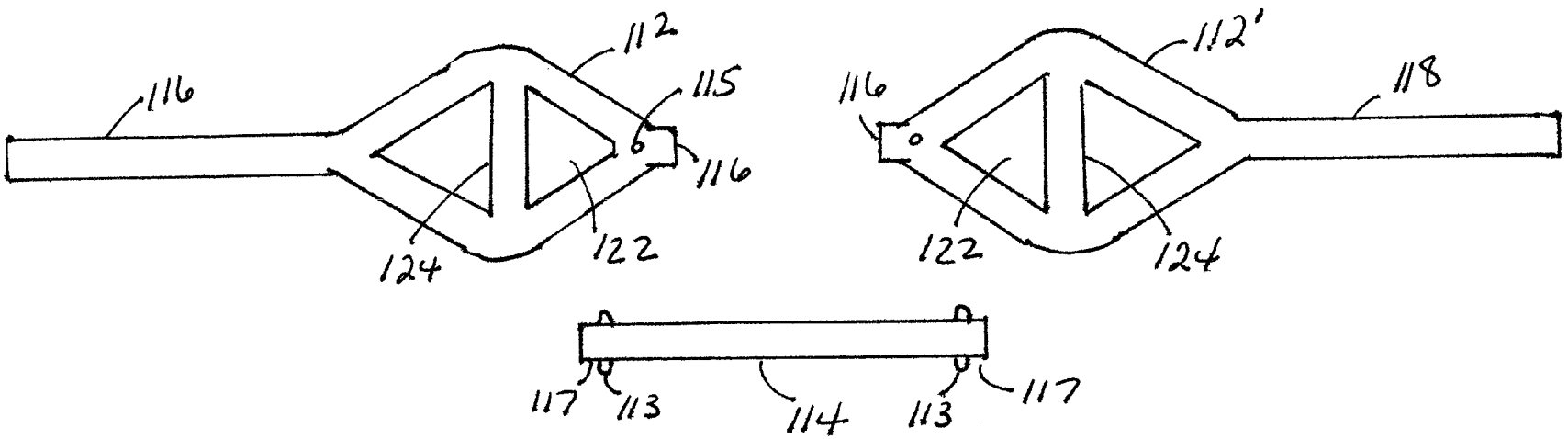
FIG. 9(*a*) is a perspective view of the disassembled portable barbell of the invention.
Figure 9B:
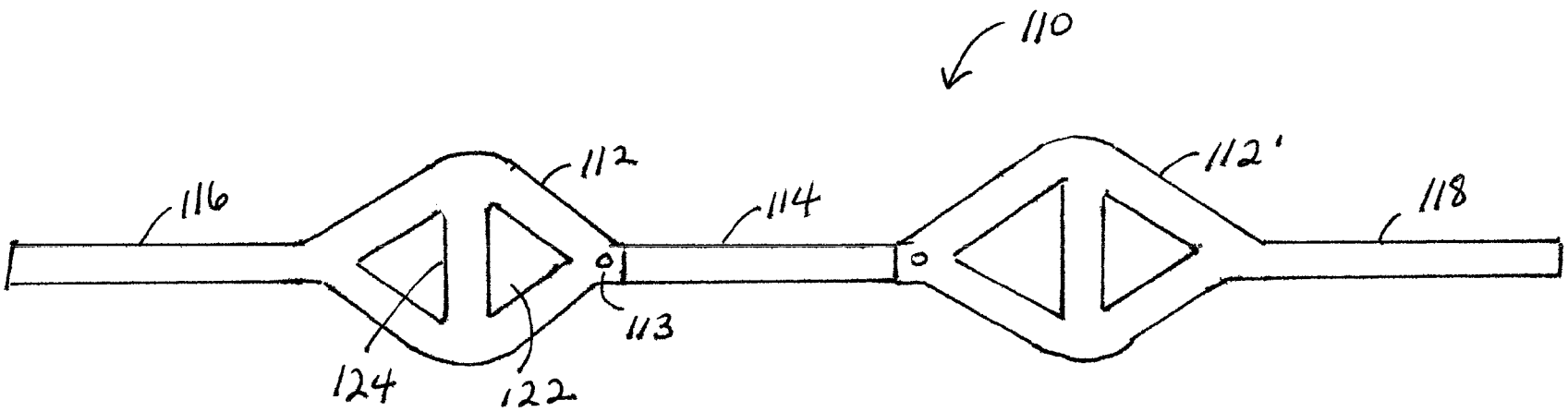

FIG. 9(*a*) discloses an embodiment of the present invention wherein the barbell is portable can be disassembled to store in a carrying bag, such as a gym bag. The disassembled barbell 110 has three parts: a first end 116 having a first gripping portion 112 and a second end 118 having a second gripping portion 112' and an intermediate region 114 having a first and second insert 117 on each end. Optionally, the intermediate region 114 can have a foam sleeve (not shown) over the region which provides cushioning of the region. The first and second gripping portions 112 and 112' have a first and second small opening 115 which is an appropriate size to engage with first and second bullet catch 113 mounted on the ends of the intermediate region 114. Additionally, the first and second gripping portions 112 and 112' each have a first and second engaging opening 116, which is designed to receive the first and second insert 117. As the first and second insert 117 are assembled by inserting into the first and second engaging openings 116, the first and second bullet catch 113 are aligned with the first and second small opening 115 to catch and hold in place the intermediate region 114. The assembled barbell 110 is shown in FIG. 9(*b*).

Optionally, the barbell 110 can have inner collars (not shown) on the proximal portion of first end 116 and the second end 118. Further optionally, the barbell 110 can have an attachment loop, clip or other attachment device (not shown) at the distal portion of ends 116 and 118. Said attachment device is suitable for use with elastic cords or exercise bands and can be used with exercise machines or stationary objects. In a preferred embodiment, the portable barbell 110 is used with two elastic cords, one for each distal portions of ends 116 and 118, that can be attached to any convenient stationary object to allow a user to exercise at locations away from a gymnasium.

Figure 2:
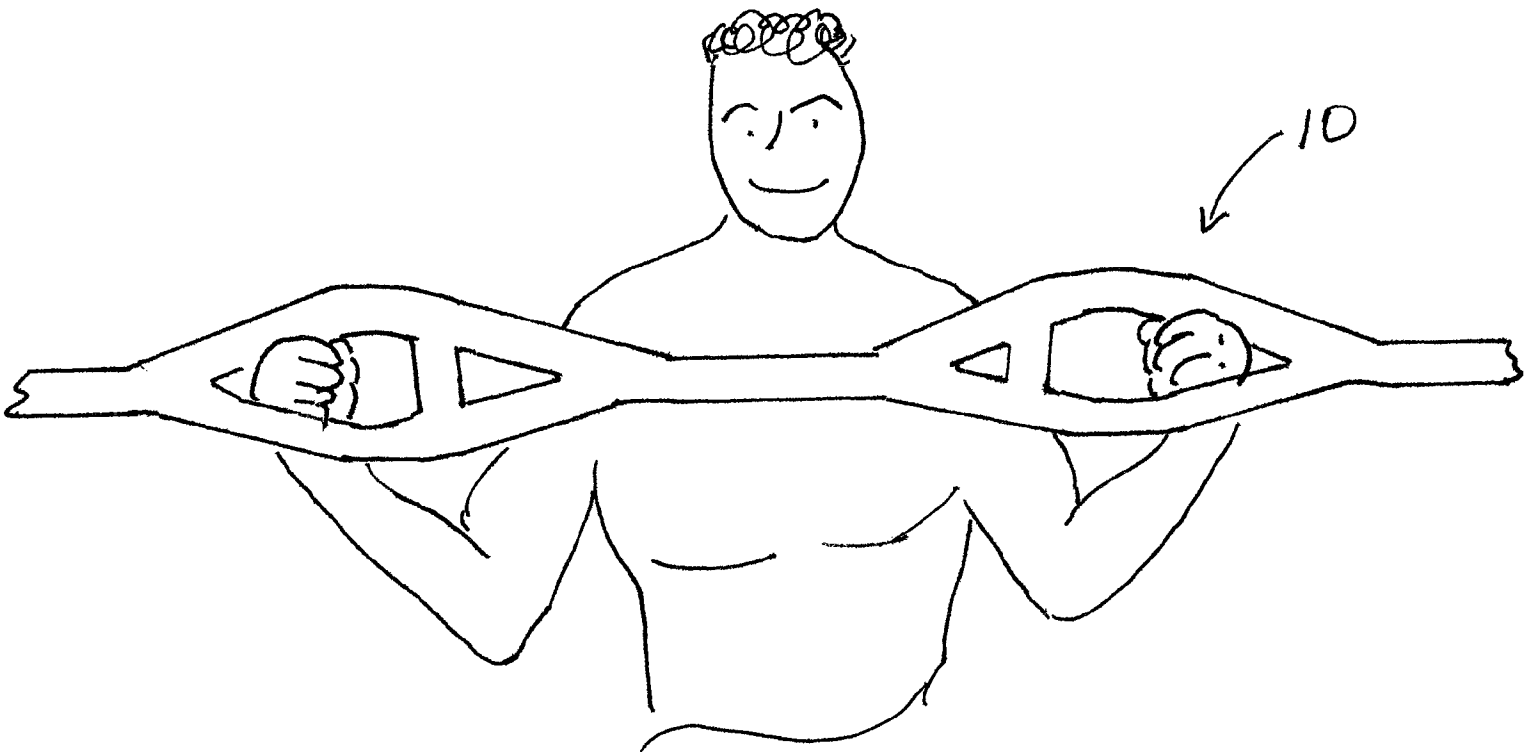
FIG. 2 is a fragmentary perspective view of a person using an embodiment of the barbell to do the military press.
Figure 3:
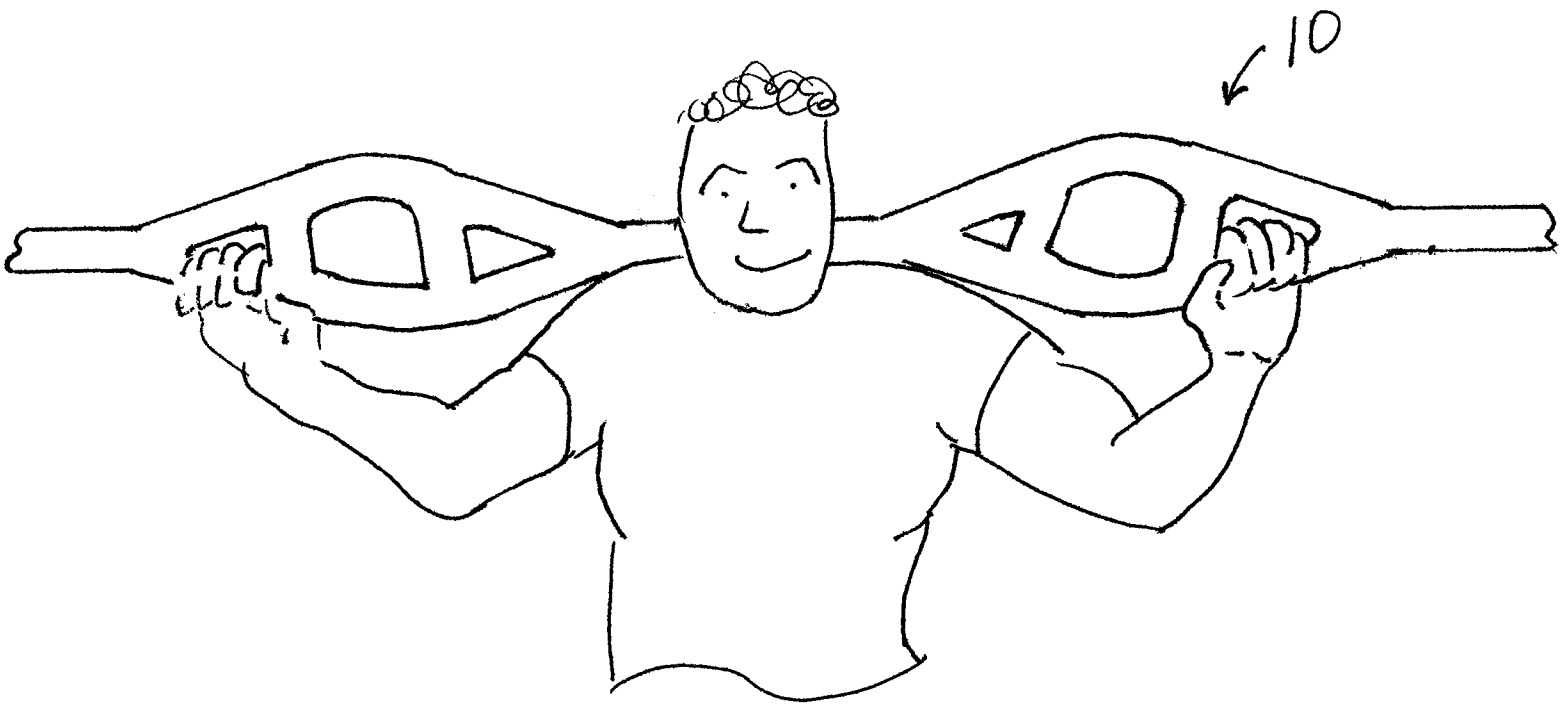
FIG. 3 is a fragmentary perspective view of a person using an embodiment of the barbell to do squats.
Figure 4:
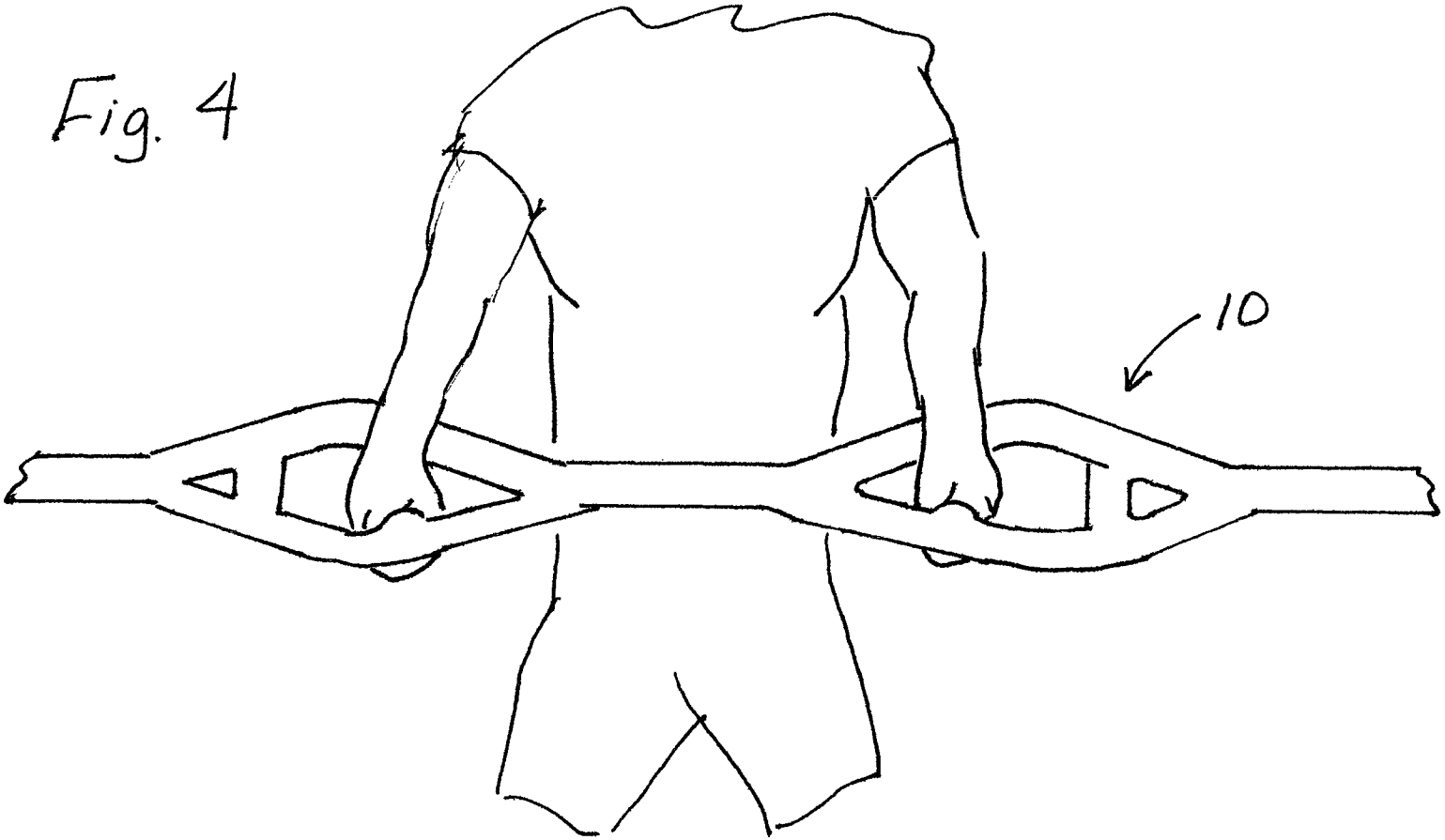
FIG. 4 is a fragmentary perspective view of a person using an embodiment of the barbell to do shoulder shrugs.
Figure 5:
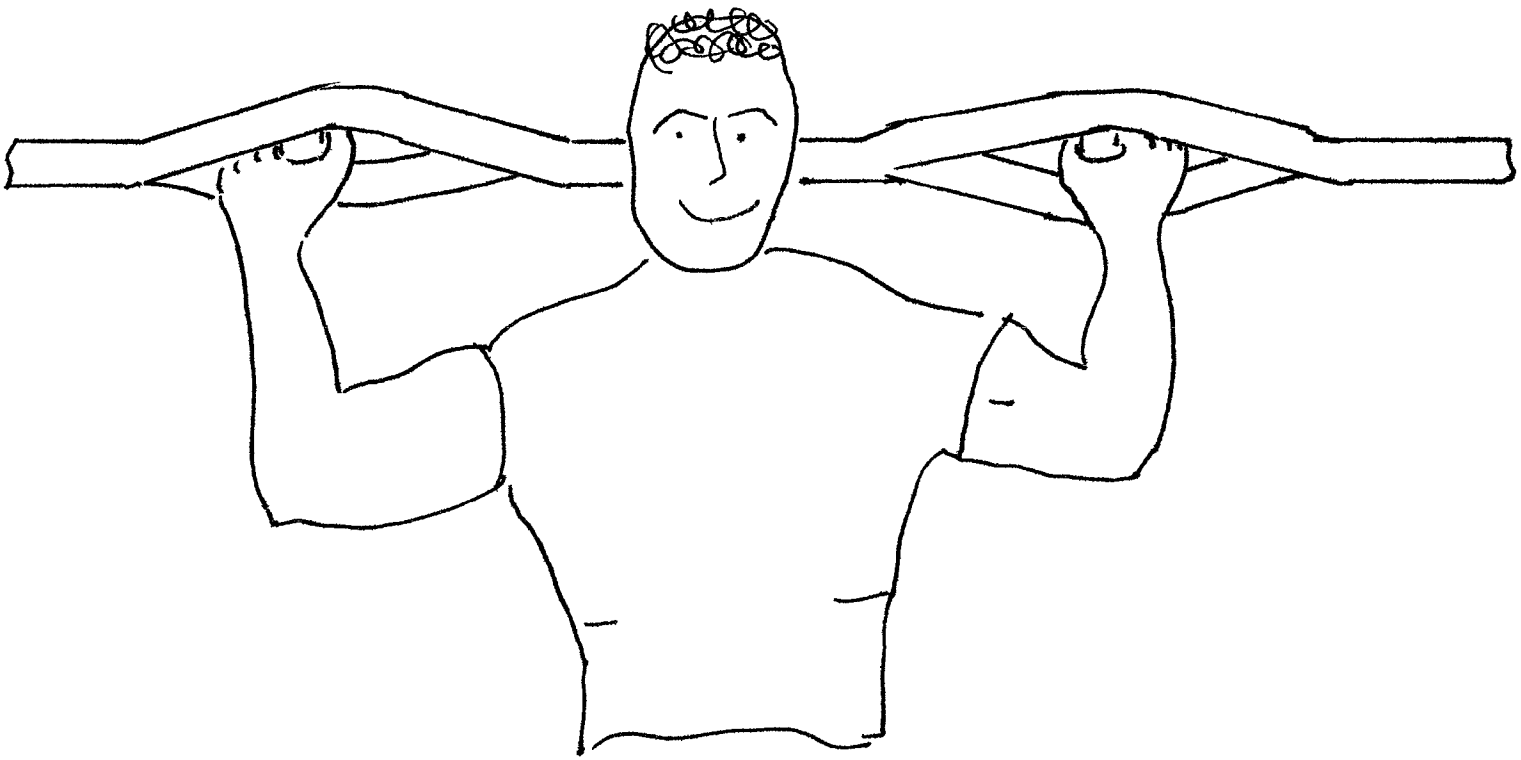
FIG. 5 is a fragmentary perspective view of a person using an embodiment of the barbell to do the behind the neck shoulder press.

FIGS. 2, 3, 4 and 5 disclose exercises with some of the preferred embodiments of the present invention. FIG. 2 discloses the use of the crossbar 24 for a palm-in grip to perform a military press. FIG. 3 discloses the use of the gripping portion 12 for an underhand palm grip to do squats. FIG. 4 discloses the use of crossbar 24 for a palm-in grip to provide a full range of motion when performing shoulder shrugs. FIG. 5 discloses the use of crossbar 24 for a palm-in grip to perform a behind the neck shoulder press.

Figure 10A:
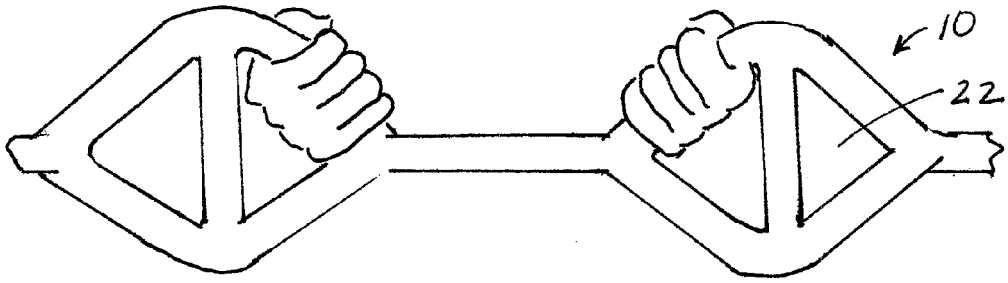
FIG. 10(*a*) is a perspective view of the barbell of the invention with an overhand grip.
Figure 10B:
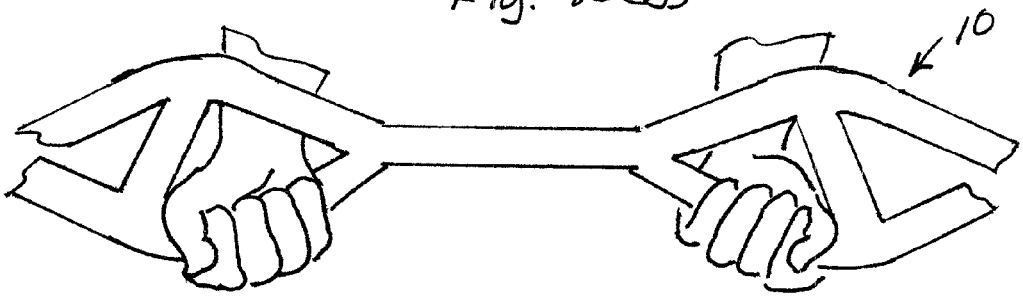
Figure 10C:
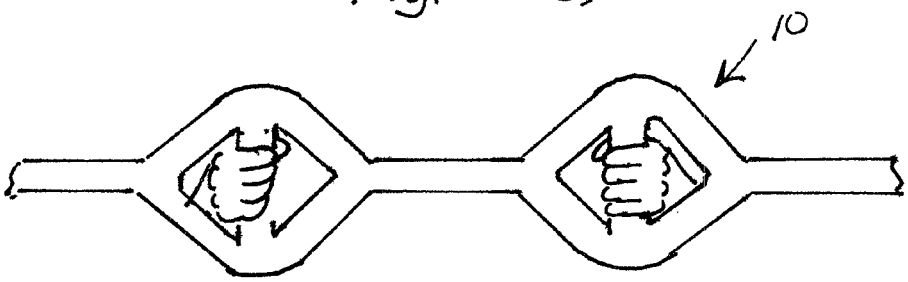

FIGS. 10(*a*), 10(*b*) and 10(*c*) disclose three possible gripping surfaces and angles in the gripping windows 22 of the present invention. FIG. 10(*a*) shows an underhand grip with the palm facing the user. FIG. 10(*b*) shows an underhand grip with the palm facing upward. FIG. 10(*c*) shows a palm-facing-palm grip on the respective crossbars in the gripping windows 22.

Another possible embodiment of the invention includes the use of exercise bands, cables or attachment devices to exercise machines, stationary objects, such as doors or walls, or other means of causing resistance with the exercise bar rather than weights added to the first and second ends.

It is understood that this invention is not limited to those embodiments and modifications described in the specification. Modifications and variations can be made by one skilled in the art without departing from the spirit and scope of the invention.

The invention claimed is:

1. A barbell with improved first and second gripping portions comprising:

a longitudinal bar having a first end, a second end, and an intermediate region, the intermediate region including a center point;

the first gripping portion and the second gripping portion on the longitudinal bar, located between the first and second ends and separated by the intermediate region, said first and second gripping portions being approximately equidistant from the center point, the first and second gripping portions being characterized by a first and second rhombus exterior portion enclosing a first and a second gripping window, wherein the windows each have at least one gripping crossbar non-parallel to the longitudinal bar, and wherein the first and second gripping portions each provide multiple gripping surfaces and gripping angles.

2. The barbell of claim 1, wherein the distance between the first and second gripping portions is from about eight to fifteen inches.

3. The barbell of claim 2, wherein the at least one crossbar is essentially perpendicular to the longitudinal bar.

4. The barbell of claim 2, wherein each of the first and second gripping windows have two crossbars, and wherein the two crossbars are parallel and are non-orthogonal to the longitudinal bar.

5. The barbell of claim 1, wherein the barbell is assembled from elements, wherein the elements are the first end, the second end, the intermediate region, and the gripping portions.

6. The barbell of claim 5, wherein the gripping portions are assembled from arcuate segments, and at least one crossbar, wherein the arcuate segments have end portions, and wherein the end portions have interior end portions.

7. The barbell of claim 6, wherein the interior end portions of the arcuate segments are knurled around their entire circumferences, wherein the knurling provides a surface for gripping.

8. The barbell of claim 6, wherein the crossbar segment is knurled around its entire length and circumference, wherein the knurling provides a surface for gripping.

9. The barbell of claim 6, wherein the interior end portions of the arcuate segments are knurled around their entire circumferences and the crossbar segments are knurled around their entire length and circumference, wherein the knurling provides surfaces for gripping.

10. The barbell of claim 7, wherein the end portions of the arcuate segments and the at least one crossbar are curved in a concave manner so that they can mate with the first and second ends and the intermediate region of the longitudinal bar.

11. The barbell of claim 10, wherein the barbell is assembled and the first end, the second end, the intermediate region and the gripping portions are assembled by welding.

12. A barbell with improved gripping portion portions comprising:

a longitudinal bar having a first end, a second end, and an intermediate region, the intermediate region including a center point;

a first gripping portion and a second gripping portion on the longitudinal bar, said first and second gripping portions located between the first and second ends and separated by the intermediate region, said first and second gripping portions being approximately equidistant from the center point, the first and second gripping portions being characterized by first and second exterior portions enclosing a first and a second gripping window, the first and second exterior portions each defined by two arcuate segments, wherein the windows have at least one gripping crossbar non-parallel to the longitudinal bar, wherein the gripping portions provide multiple gripping surfaces and angles, wherein the gripping portions are assembled from arcuate segments and at least one crossbar, and wherein the arcuate segments have end portions, and wherein the end portions have interior end portions.

13. The barbell of claim 12, wherein the end portions of the arcuate segments and the at least one crossbar are curved in a concave manner so that they can mate with the first and second ends and the intermediate region of the longitudinal bar.

14. The barbell of claim 13, wherein the barbell is assembled and the first end, the second end, the intermediate region and the gripping portions are assembled by welding.

15. The barbell of claim 12, wherein the distance between the first and second gripping portions is from about eight to fifteen inches.

16. The barbell of claim 1, wherein the barbell has one crossbar, and the first and second gripping windows each have three gripping surfaces and angles.

17. The barbell of claim 12, wherein the barbell has one crossbar, and the first and second gripping windows each have three gripping surfaces and angles.

18. The barbell of claim 1, wherein the barbell can be dissembled into three parts, a first end, a second end, and an intermediate region.

19. The barbell of claim 12, wherein the barbell can be dissembled into three parts, a first end, a second end, and an intermediate region.

20. The barbell of claim 12, wherein the interior end portions of the arcuate segments are knurled around their entire circumferences and the at least one crossbar is knurled around its entire length and circumference, wherein the knurling provides a surface for gripping.

* * * * *